United States Patent [19]

Pollack

[11] Patent Number: 4,986,013

[45] Date of Patent: Jan. 22, 1991

[54] POSTER FRAME

[76] Inventor: Ronald M. Pollack, 73-19 37th Road, Jackson Heights, N.Y. 11372

[21] Appl. No.: 502,115

[22] Filed: Mar. 29, 1990

[51] Int. Cl.[5] ..... A47G 1/06

[52] U.S. Cl. ..... 40/152; 40/154; 40/156; 40/611; 40/617

[58] Field of Search ..... 40/152, 152.1, 154, 40/155, 156, 605, 611, 618, 617

[56] References Cited

U.S. PATENT DOCUMENTS

| | | | |
|---|---|---|---|
| 452,867 | 5/1891 | Marsh | 40/155 |
| 838,816 | 12/1906 | Sherwood | 40/155 |
| 2,259,434 | 10/1941 | Blodgett | 40/154 |
| 3,797,795 | 3/1974 | Hemgren | 40/156 |
| 3,914,892 | 10/1975 | Mohr | 40/152 |
| 4,030,219 | 6/1977 | Donovan | 40/611 |
| 4,356,647 | 11/1982 | Ferris | 40/152.1 |
| 4,669,209 | 6/1987 | Pollack | 40/152.1 |
| 4,827,648 | 5/1989 | Danin | 40/152 |

FOREIGN PATENT DOCUMENTS

| | | | |
|---|---|---|---|
| 2059244 | 6/1972 | Fed. Rep. of Germany | 40/152 |
| 8706754 | 11/1987 | World Int. Prop. O. | 40/152 |

*Primary Examiner*—Gary L. Smith
*Assistant Examiner*—F. Saether
*Attorney, Agent, or Firm*—Collard, Roe & Galgano

[57] ABSTRACT

A frame for a poster and the like, includes at least one edge support for an edge of the poster, having an inverted generally T-shaped back plate having a base leg and an upstanding leg disposed generally normally to the base leg and having a first end interconnected, generally centrally of the base leg and a second end. The edge support also has a generally C-shaped dome member having a center section interconnected with the second end of the upstanding leg of the back plate and two curved legs, each of which extend toward opposite ends of the base leg of the base plate to define a gap between the ends of the curved legs and the base leg for the purpose of receiving the respective edge of the poster. The frame also includes at least one fastening element associated with the edge support for fastening the poster edge thereto having first and second legs and being substantially C-shaped to overlay the C-shaped member of the edge support and engage therewith with a snap fit. The legs of the fastening element extend beyond the ends of the curved legs of the C-shaped dome member and toward the base leg of the back plate, to press the poster edge against the base leg to thereby fasten the same. A double-sided poster frame is also disclosed.

23 Claims, 4 Drawing Sheets

POSTER FRAME

BACKGROUND OF THE INVENTION

The present invention relates to a picture frame for framing pictures, posters, prints, signs and the like. More particularly, it relates to such a picture frame for the inexpensive, yet aesthetically pleasing and practical framing of a wide variety of pictures for both residential and commercial use.

In my earlier patent for a picture frame, U.S. Pat. No. 4,669,209, I have described a picture frame which is very inexpensive and so easy to assemble that anyone can do so with aesthetic and precise results. The picture frame is designed to eliminate the need for a picture glass or other transparent covering and semi-rigid backing, normally used for most picture frames. It was specifically intended for framing posters, which tend to be relatively large, and prints. Artistic decor utilizing posters and large prints has come into vogue in recent years. Where such poster-type pictures are inexpensive, it is often times not worthwhile to provide the same with a glass covering and a semi-rigid backing, together with a frame, for the entire assembly since these various extra elements often cost far in excess of the original poster to be framed. Thus, on many occasions, one sees attractive poster-like pictures which are tacked or otherwise fastened to a wall for the purpose of exhibiting the picture and maintaining it flat. Such securement of a poster-like picture to a wall not only causes damage to the wall but very often tends to be unsightly, in that tacks or tape, or other objects are utilized in fastening the picture to the wall.

To overcome this problem, my earlier patent provided a picture frame for poster-like pictures which included at least a top picture edge support, and preferably a bottom picture edge support, and fastening elements which fasten the respective edges of the poster-like picture frame to the top and bottom supports. Each picture edge support includes a flat back plate which extends substantially the length of the edge of the picture being framed and a substantially C-shaped portion or member, one leg of which is connected to the outer edge of the back plate, while the other leg extends downwardly toward the flat back plate to define a gap between the terminus thereof and the back plate. The picture edge support is preferably formed of extruded plastic. The fastening elements are also generally C-shaped and resiliently engaged around the generally C-shaped member of the edge support with the inside leg extending into the gap beyond the terminus of the inside leg of the C-shaped member and the flat back plate, so as to press the edge of the poster-like picture inserted into the gap against the back plate of the edge support. The invention also contemplates the provision of edge supports for each side edge of the poster-like picture, wherein the fastening elements are in the form of elbow-shaped corner pieces, which engage the adjacent ends of adjacent edge supports so as to secure or fasten the poster-like picture to the flat back plates of the supports at the corners of the picture. While quite satisfactory in use, I have found that for certain applications a more rigid or stiffer picture frame is needed. In addition, the picture frame is not suitable for joining multiple pictures or posters together. It is also not particularly suitable for double-sided signs, such as may be often used in store windows and the like, where it is desired that the customer can read the same either on the outside of the store or on the inside thereof.

SUMMARY OF THE INVENTION

Accordingly, it is an object of the present invention to provide an improved picture frame for poster-like pictures, wherein no support elements or structure are utilized with the picture other than the picture frame itself, which is of simple and inexpensive construction.

It is also an object of the present invention to provide such a picture frame which affords greater rigidity in the frame structure and allows greater versatility of use in connection with the grouping of different pictures and the use of double-sided pictures or signs.

Certain of the foregoing and related objects are attained in a frame for a poster and the like, which includes at least one edge support for an edge of the poster and at least one fastening element associated with the edge support for fastening the poster edge thereto. The edge support extends substantially the length of the poster edge and includes an inverted generally T-shaped back plate extending the length thereof, having a base leg and an upstanding leg disposed generally, normally to the base leg and having a first end interconnected, generally centrally of the base leg and a second end. The edge support also has a generally C-shaped dome member having a center section interconnected with the second end of the upstanding leg of the back plate and two curved legs, each of which extend toward opposite ends of the base leg of the base plate to define a gap between the ends of the curved legs and the base leg for the purpose of receiving the respective edge of the poster. The fastening element has first and second legs and is substantially C-shaped to overlay the C-shaped member of the edge support and engage therewith with a snap fit. The legs of the fastening element extend beyond the ends of the curved legs of the C-shaped dome member and toward the base leg of the back plate, to press the poster edge against the base leg to thereby fasten the same.

Certain of the foregoing and related objects are also attained in a double-sided frame for a poster and the like, which includes an edge support for an edge of the poster and a pair of fastening elements associated with the edge support for fastening the poster edge thereto. The edge support extends substantially the length of the poster edge and has a generally rectilinear base plate, having two opposite sides and ends, extending the length thereof, and a pair of substantially C-shaped dome members interconnected to opposite ends of the base plate in a mirror-image fashion. Each C-shaped dome member has first and second legs extending toward the first and second legs of the opposed C-shaped dome member, to define a gap between the ends thereof for the purpose of receiving the respective edge of the poster. The fastening elements each have first and second legs and are substantially C-shaped to overlay the C-shaped dome members of the edge support and engage therewith with a snap fit. The legs of the fastening elements extend beyond the terminus of the legs of the C-shaped dome members and cooperate so as to wedge and secure the poster edge therebetween.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 2:
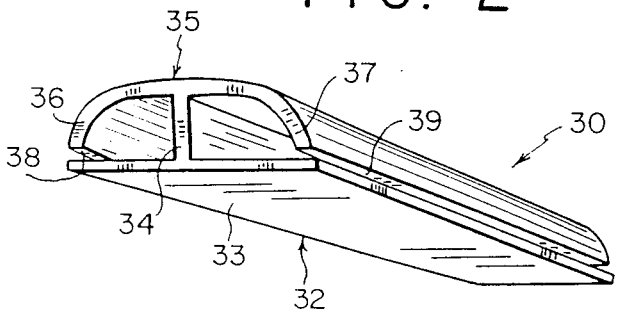
FIG. 2 is a perspective view of an edge support for a picture frame, according to the present invention.
Figure 1:
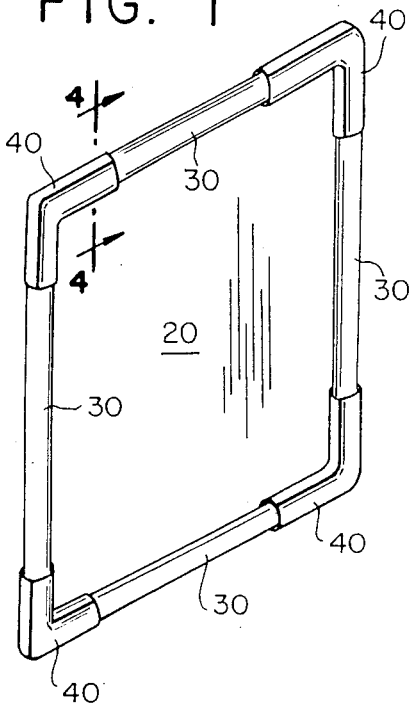
FIG. 1 is a perspective view of an assembled picture frame, according to the present invention, framing a poster-like picture.

Turning now to the drawings, there is shown in FIG. 1, a poster-like picture, designated 20, which is generally formed of relatively thin paper or paperboard. For the purpose of maintaining picture 20 flat so that it may be hung from a wall or similar structure without distortion, the upper, lower and side edges of picture 20 are provided with substantially identical edge supports, generally designated 30, to which fastening elements, generally designated 40, are engaged for securing picture 20 to the edge supports 30. The edge supports 30 are preferably made of plastic extrusions and the fastening elements 40 are preferably formed of injection molded plastic As clearly seen in FIG. 2, each edge support 30 includes a back plate 32, having a generally inverted T-shaped profile which is composed of a substantially flat base plate 3 and an upstanding leg 34, disposed centrally and normally thereto. A substantially C-shaped dome member 35 is interconnected to the top end of leg 34 and is provided with legs 36, 37, which curve downwardly toward the lateral edges of base plate 33, to define slots or gaps 38, 39, between the terminus of legs 36, 37 and the ends of base plate 33, respectively. Gaps 38, 39 are sufficient to permit the insertion therein of the edge of the poster-like picture frame 20.

Figure 3:
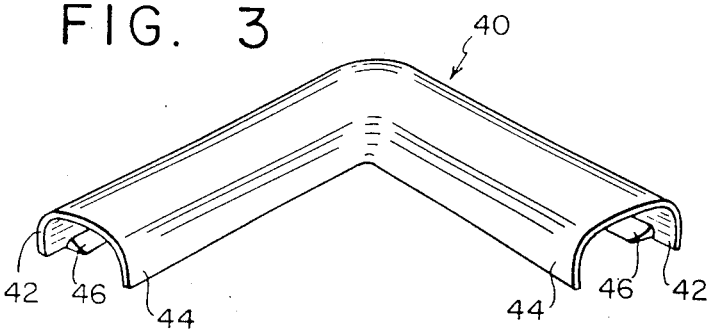
FIG. 3 is a perspective view of an elbow-shaped fastening element for the present invention.

As shown in FIG. 3, elbow-shaped fastening element 40 is shown as having a substantially C-shaped configuration which basically conforms to the shape of dome member 35 of edge support 30, but having an inside diameter slightly smaller than the outside diameter of member 35, so that a snap fit results when fastening element 40 is engaged with member 35 because of the increased tension therebetween. The depending legs 42, 44 of fastening element 40, are provided adjacent their ends with engagement cams or bosses 46, 48, respectively. The configuration and construction of these fastening elements are similar to that of the connecting elements used in an electric cord holder assembly described in my U.S. Pat. No. 4,563,542 (the subject matter of which is incorporated herein by reference thereto).

Figure 4:
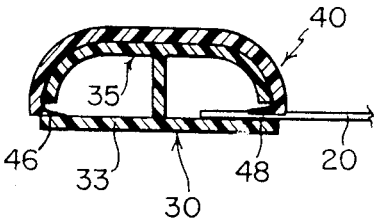
FIG. 4 is a cross-sectional view, taken along lines 4—4 of FIG. 1.

As seen best in FIG. 4, the edge of the poster 20 is inserted into the gap 39, such that the edge thereof lies against base plate 33. Then, the C-shaped fastening element 40 is pressed over the top of dome member 35, such that the bosses or engagement cams, 46, 48, extend into gaps 38, 39 in a snap fit manner, as a result of which the poster 20 is pressed against the base plate 33 and held securely between it and the bosses 48.

Figure 5:
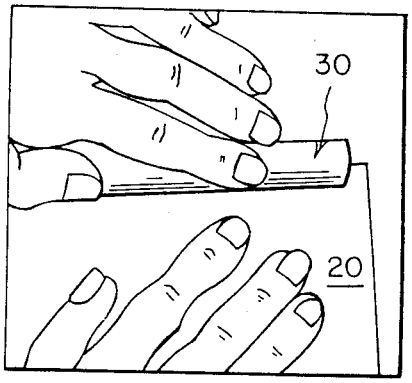
FIGS. 5–7 sequentially illustrate the assembly procedure for assembly the picture frame of the present invention.
Figure 6:
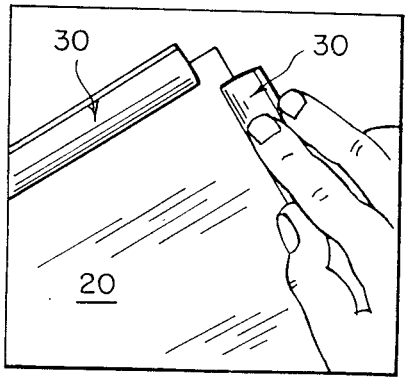
Figure 7:
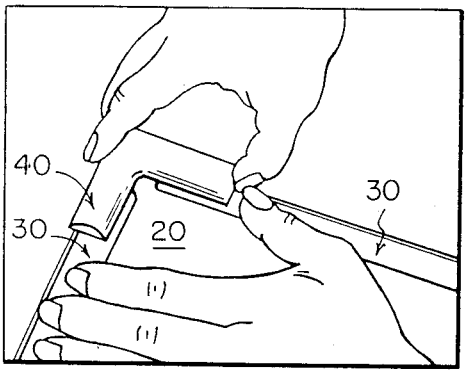

FIGS. 5–7 better illustrate the sequence of steps in forming the picture frame of the present invention. As shown in FIG. 5, the first step is to insert an edge of the poster 20 into the gap 39 of edge supports 30 along each of the edges thereof. Then, the elbow-shaped fastening elements 40 are snapped over the corners of each of the posters, as shown in FIG. 7, such that each fastening element connects two adjacent edge supports 30. This results in the poster frame, as shown in FIG. 1.

This particular embodiment provides an improvement over applicant's earlier patent, U.S. Pat. No. 4,669,209 (the subject matter of which is incorporated herein by reference thereto), in that the poster can be inserted into either or both sides of the edge support 30 so that a series of posters could be hung in a composite or sequential manner (as will be discussed hereinafter). In addition, this embodiment also provides improved strength, in that a wedge-like connection is formed at both sides of the edge support 30 with the fastening element 40, which improves the gripping hold of fastening element 40 and improves the rigidity of the structure. Furthermore, while the edge support is shown as having equal size gaps, they could be of different dimensions, so that one side could be used for thin paper, while the other side could be used for paperboard which has a larger thickness. The slots are preferably dimensioned to be equal to or slightly greater than the intended thickness of the poster to be hung. In addition, although the openings are shown as being a fixed open slot, they could have a flex-type opening, whereby the slot would be substantially covered but could be flexed open by the insertion of the paper or paperboard due to the resilient nature of the legs 36, 37.

Figure 8:
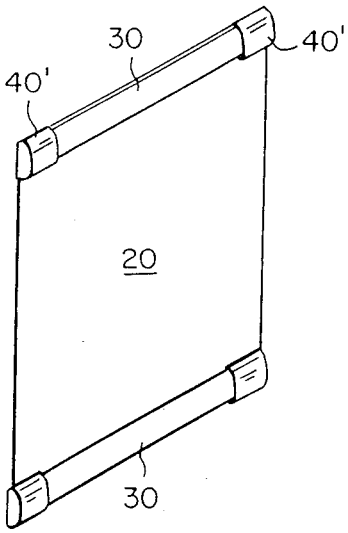
FIG. 8 is a perspective view of an assembled scroll-like picture frame, according to another embodiment of the present invention.
Figure 9A:
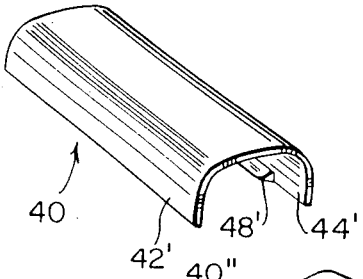
FIGS. 9*a* and 9*b* are top and bottom perspective views, respectively, of a rectilinear fastening element for the scroll-like picture frame shown in FIG. 8.
Figure 9B:
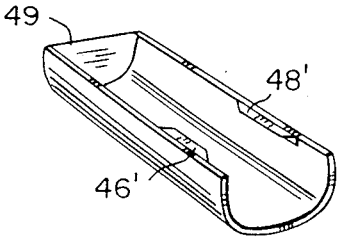

FIG. 8 discloses an alternate embodiment of the picture frame, wherein a scroll-type arrangement is depicted. In this case, the upper edge and lower edge of picture 20 are provided with substantially identical edge supports 30, to which fastening elements 40' are engaged for securing picture 20 to the edge supports. As seen best in FIGS. 9*a* and 9*b*, the rectilinear fastening elements 40' which serve as end caps also have a C-shaped profile defined in part by depending legs 42', 44' which are also provided with bosses 46', 48' adjacent one end thereof. Fastening elements 40' are also provided with a closed wall 49 at one end, so as to afford a neat, aesthetic appearance for the scroll-like frame. Although not illustrated, it is possible that the scroll could be continued by inserting paper at both sides of the edge support 40 of either the top or bottom end such that a series of scroll-like framed pictures would be joined together.

Figure 10:
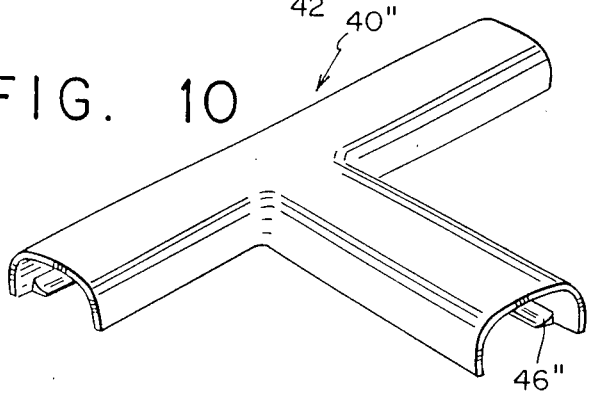
FIGS. 10 and 11 are top and bottom perspective views, respectively, of a T-shaped fastening element used in connection with the picture frame of the present invention.
Figure 11:
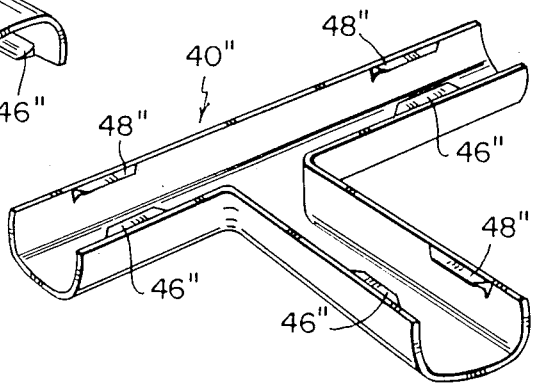

FIGS. 10 and 11 illustrate a fastening element 40'' having a T-shaped profile which can be used if it is desired to secure together a series of pictures. These T-shaped fastening elements 40'' are similar to the other fastening elements 40, 40', in that they have similar camming elements or bosses 46'', 48'' adjacent each end thereof, which function in a similar manner. The use of such T-shaped fastening elements 40'' will be described in greater detail hereinafter.

Figure 12:
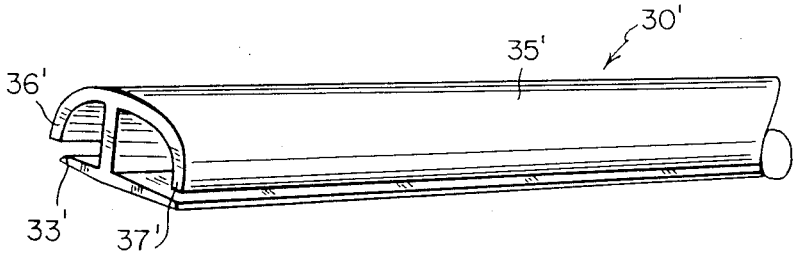
FIG 12 is a fragmentarily-illustrated perspective view of another embodiment of an edge support for a picture frame embodying the present invention.

The poster frames of the present invention can be hung by conventional means, wires, hooks, Velcro fasteners, etc. However, to facilitate the hanging of the poster frame, one or more of the edge supports 30' of the poster frame can be modified, as shown in FIGS. 12–14. As can be seen therein, one edge of the base plate 33' is shortened, as is the corresponding leg 36' of the C-shaped dome member 35', so as to provide a greater opening for the insertion of a hanger element 50. Hanger element 50 has a U-shaped base 52 which is configured and dimensioned to be frictionally and slidably receivable within the opening defined between the base plate 33 and the leg 36' of the C-shaped dome member 35' of the edge support 30' and an eyelet section 54 having an opening 55 for the fastening of a hanging wire or nail for hanging the poster. This modified edge support 30' could be substituted for the top edge of the poster frame so that it may be hung by a nail or the like. Alternatively, it could be used to form the side edge supports for the picture frame in which case a wire (not shown) could be attached to the two eyelets to permit the picture frame to be hung by the wire across the back of the picture and frame. The dimension of the hanger element 50 is selected such that the mounting of the same requires the aid of a tool, pin or the like and so that it will not slide freely and will stay in its intended position, as shown in FIGS. 13*b* and 14. This is facilitated by preferably providing a small protuberance 57 on the bottom or back of the hanger element which allows easy entry of the hanger element into the slot by a camming action. When the picture is hung, the protuberance will cause the hanger element when in its intended position to tilt upwardly slightly causing it to grip the channel surface more firmly so as to prevent unintentional sliding.

FIGS. 15–19 illustrate a further embodiment of the invention, wherein a double-sided poster frame is shown. The various elements and the manner of attachment and connection are the same, except for the edge supports 60 which are seen best in FIGS. 16 and 17. Edge support 60 is essentially the same as edge support 30 shown in FIG. 2, except for the fact that it is doubled and the base plate 33 of the back plate 32 is preferably omitted. This embodiment is specifically designed for use with semi-rigid poster board, which could have graphics or on both sides thereof. This permits it to be used, e.g., as a sign in a window or a bank, etc., so that it may be viewed from both sides.

Figure 16:
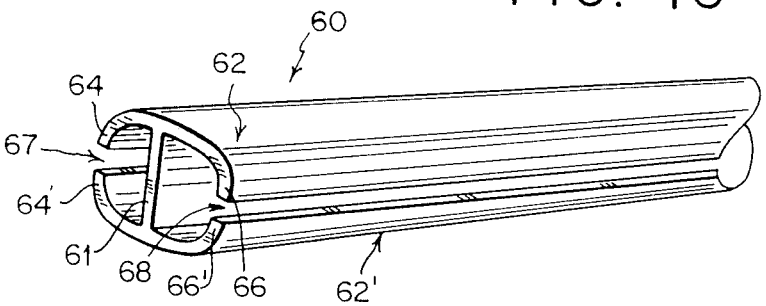
FIG. 16 is a fragmentarily-illustrated perspective view of a slightly modified edge support, used in connection with the embodiment of FIG. 15.

As shown in FIG. 16, edge support 60 comprises a flat generally rectilinear base plate 61 having two opposite ends to which a pair of C-shaped dome members 62, 62' are interconnected in a mirror-image fashion. The C-shaped dome members 62, 62' have corresponding opposing legs 64, 64' and 66, 66', the ends of which extend toward and oppose the corresponding ends of the other dome member so as to define a gap or slot 67, 68 between the ends thereof for the purpose of receiving the respective edge of the poster.

Figure 15:
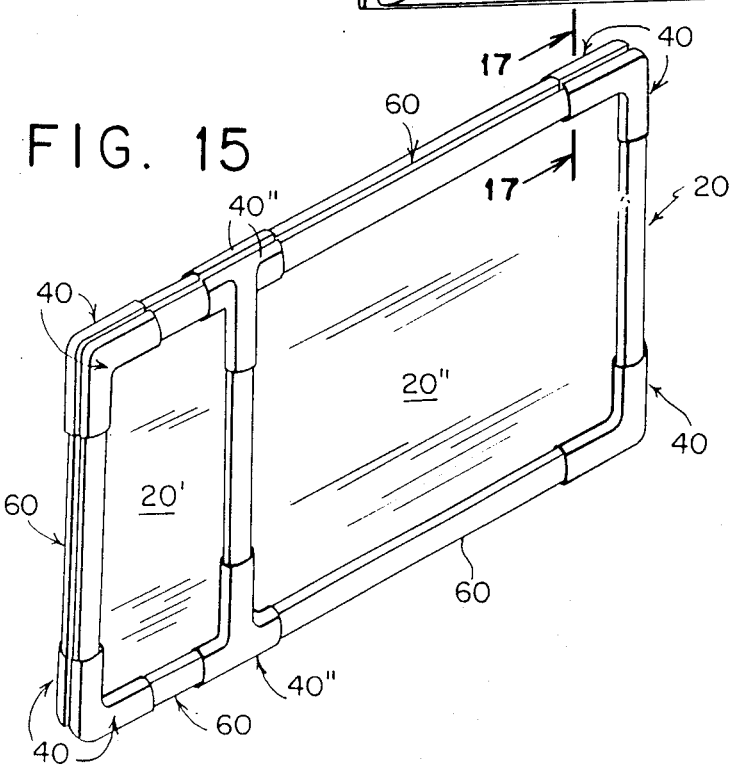
FIG. 15 is a perspective view of another embodiment of an assembled picture frame, according to the present invention, used for double-sided and/or multiple-framed pictures.
Figure 17:
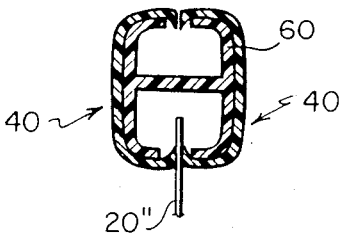
FIG. 17 is a sectional view taken along line 17—17 of FIG. 15.

The fastening elements 40, 40',40'' are used essentially in the same manner as for the embodiments of FIGS. 1 and 8, except the number employed is doubled since they are used on both sides of the picture frame, as seen in FIG. 15. The assembly procedure of FIGS. 5–7 would be the same except, here too, the steps would be repeated to add fastening elements to the reverse side of the poster frame. In particular, the edges of the poster 20', 20'' are inserted into the gap 67, 68 of the edge supports 60 along each of the edges thereof. The elbow-shaped fastening elements 40 are snapped over the outer corners of each of the posters 20', 20'' such that each fastening element connects two adjacent edge supports. Then the poster and partially mounted frame is turned over and the fastening elements are snapped over the reverse side of the corners of the poster. In this way, the poster is securely wedged in a vise-like grip between the engagement bosses 46'', 48'' of the fastening elements 40'', as shown in FIG. 17.

As shown in FIG. 15, two or more double-sided posters 20', 20'' can be joined by utilizing the T-shaped fastening elements which can optionally be used with either the one or double-sided embodiments. Although not illustrated, other configured connecting elements, such as X-shaped, could also be used for connecting a variety of different sized and configured posters.

Figure 13A:
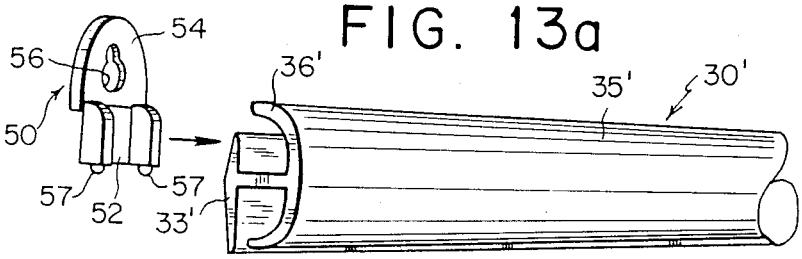
FIGS. 13*a* and 13*b* are perspective views of the edge support shown in FIG. 12, showing a hanger support, prior and after insertion in the channel of the edge support, respectively.
Figure 13B:
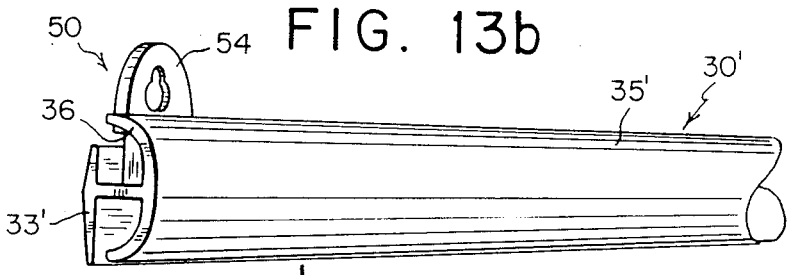
Figure 14:
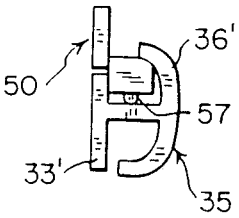
FIG. 14 is an end view of the assembly shown in FIG. 13*b;*
Figure 19:
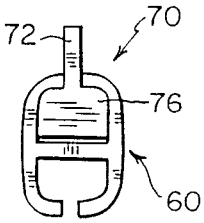
FIG. 19 is an end view of the assembly shown in FIG. 18*b*.
Figure 18A:
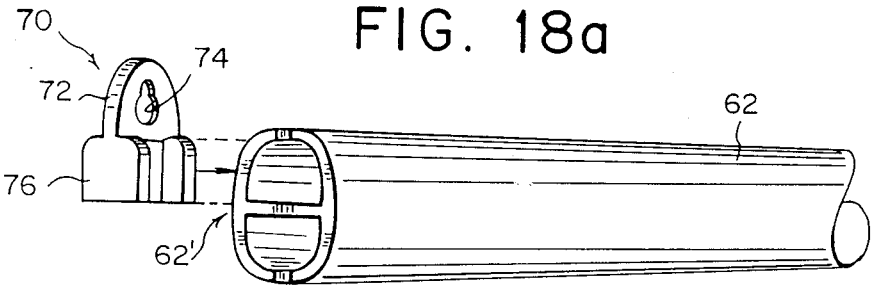
FIGS. 18*a* and 18*b* are perspective views comparable to that of FIG. 16, but showing the use of a hanger support in connection therewith, prior to and after insertion within the channel of the edge support, respectively.
Figure 18B:
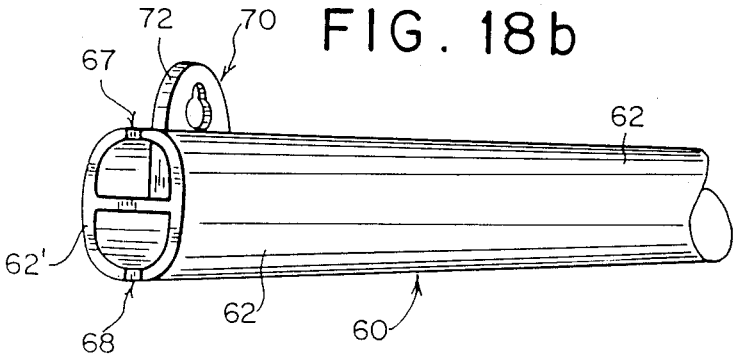

FIGS. 18*a*, 18*b* and 19 illustrate the use of a modified hanger support 70 similar in function and construction and use to the hanger element of FIGS. 13*a*, 13*b* and 14. Hanger support 70 has been modified to accommodate the configuration of double edge support 60 of FIG. 16. In particular, hanger element 70 has an upper flat eyelet section 72 having an opening 74 for the fastening of a hanging wire or nail for hanging the poster. The eyelet section 72 is connected to a base-section 76 having an H-shaped, cross-section which is frictionally and slidably receivable within the channels of the edge supports. This hanger support 70 could be inserted in top edge support 60 of the poster frame, so that it may be hung by a nail or the like. Alternatively, it could be inserted in the side edge supports 70 for the picture frame in which case a wire (not shown) could be attached to the two eyelets to permit the picture frame to be hung by the wire across the back of, or from above, the picture and frame. The dimension of the hanger element 50 is selected such that the mounting of the same requires the aid of a tool, pin or the like and so that it will not slide freely and will stay in its intended position, as shown in FIG. 18*b*. Although not illustrated, a protuberance could also be added to the base section 76 to facilitate insertion and gripping when in its intended position.

While only several embodiments of the present invention have been shown and described, it is obvious that many changes and modifications may be made thereunto without departing from the spirit and scope of the invention.

What is claimed is:

1. A frame for a poster comprising:

at least one edge support for an edge of said poster, said edge support extending substantially the length of said poster edge and including an inverted generally T-shaped back plate extending the length thereof, having a base leg and an upstanding leg disposed generally, normally to said base leg and having a first end interconnected, generally centrally of said base leg and a second end, and a generally C-shaped dome member having a center section interconnected with said second end of said upstanding leg of said back plate and two curved legs, each of which extend toward opposite ends of said base leg of said base plate to define a gap between the ends of said curved legs and said base leg for the purpose of receiving the respective edge of said poster; and at least one fastening element associated with said edge support for fastening said poster edge thereto, said at least one fastening element having first and second legs and being substantially C-shaped to overlay the C-shaped member of said edge support and engage therewith with a snap fit, said legs of said fastening element extending beyond the ends of said curved legs of said C-shaped dome member and toward said base leg of said base plate, to press the poster edge against said base leg to thereby fasten the same and provide a stiffer frame, said C-shaped fastening element having inwardly directed engagement cams at the ends of said first and second legs thereof, the engagement cam of said first leg being adapted to engage by means of a snap fit the end of the first leg of said C-shaped dome member of said edge support, and the engagement cam of said second leg of said fastening element being adapted to engage by means of a snap fit the end of said second leg of said C-shaped dome member and so that a wedge-like connection is formed at both sides of said edge support with said fastening element, thereby improving the gripping hold of said fastening element and improving the rigidity of the structure.

2. The frame as defined in claim 1, wherein at least two edge supports are provided, one for the top edge of said poster and one for the bottom edge.

3. The frame as defined in claim 1, wherein a fastening element is provided at each end of said edge support.

4. The frame as defined in claim 3, wherein the outer end of each fastening element is provided with a wall closing the end thereof.

5. The frame as defined in claim 1, further comprising an edge support for each side edge of said poster.

6. The frame as defined in claim 5, wherein the fastening elements comprise elbow-shaped corner fastening elements which engage with the ends of adjacent edge supports and fasten the corners of said poster to adjacent edge supports.

7. The frame as defined in claim 6, wherein an elbow-shaped corner fastening element is provided at each corner of said poster to engage with adjacent ends of adjacent edge supports.

8. The frame as defined in claim 1, wherein said edge supports are formed of plastic extrusions and said fastening elements are formed of injection molded plastic.

9. The frame as defined in claim 1, wherein said fastening element is T-shaped.

10. The frame as defined in claim 1, additionally including hanger means for hanging said frame, wherein said hanger element is so dimensioned and configured that upon mounting of the same within one of said slotted channels, it will not slide freely and will stay in its intended position.

11. The frame as defined in claim 10, wherein said edge support defines two interior slotted channels and wherein said hanger means comprises a hanger support having a base member configured for slidable receipt within one of said channels and an eyelet secured to said base member and extending from said slotted channel.

12. The frame as defined in claim 11, wherein said hanger element is provided with a protuberance on said base member which causes said hanger element, when in its intended position, to tilt upwardly slightly causing it to grip the channel more firmly so as to prevent unintentional sliding.

13. A frame for a double-sided poster comprising:

an edge support for an edge of said poster, said edge support extending substantially the length of the poster edge and including a generally rectilinear base plate extending the length thereof, having two opposite sides and ends and a pair of substantially C-shaped dome members interconnected to opposite ends of said base plate in a mirror-image fashion, each C-shaped dome member having first and second legs extending toward the first and second legs of the opposed C-shaped dome member, to define a gap between the ends thereof for the purpose of receiving the respective edge of said poster; and a pair of fastening elements associated with said edge support for fastening said poster edge thereto, said fastening elements each having first and second legs and being substantially C-shaped to overlay the C-shaped dome members of said edge support and engage therewith with a snap fit, said legs of said fastening elements extending beyond the terminus of the legs of said C-shaped dome members so as to cooperate with one another to wedge and secure the poster edge therebetween in a vise-like manner.

14. The frame as defined in claim 13, wherein said C-shaped fastening element has inwardly directed engagement cams at the ends of said first and second legs thereof, the engagement cam of said first leg being adapted to engage by means of a snap fit the end of the first leg of said C-shaped dome member of said edge support, and the engagement cam of said second leg of said fastening element being adapted to engage by means of a snap fit the end of said second leg of said C-shaped dome member.

15. The frame as defined in claim 14, wherein a fastening element is provided at each end of said edge support.

16. The frame as defined in claim 15, further comprising an edge support for each side edge of said poster.

17. The frame as defined in claim 16, wherein said fastening elements comprise elbow-shaped corner fastening elements which engage with the ends of adjacent edge supports and fasten the corners of said poster to adjacent edge supports.

18. The frame as defined in claim 17, wherein a pair of elbow-shaped corner fastening elements are provided at each corner with said poster to engage with adjacent ends of adjacent edge supports.

19. The frame as defined in claim 13, wherein said edge supports are formed of plastic extrusions and said fastening elements are formed of injection molded plastic.

20. The frame as defined in claim 13, wherein said fastening element is T-shaped.

21. The frame as defined in claim 13, additionally including hanger means for hanging said frame.

22. The frame as defined in claim 21, wherein said edge support defines two interior slotted channels and wherein hanger means comprises a hanger support having a base member configured for slidable receipt within one of said channels and an eyelet secured to said base member and extending from said slotted channel, wherein said hanger element is so dimensioned and configured that upon mounting of the same within one of said slotted channels, it will not slide freely and will stay in its intended position.

23. The frame as defined in claim 22, wherein said hanger element is provided with a protuberance on said base member which causes said hanger element, when in its intended position, to tilt upwardly slightly causing it to grip the channel more firmly so as to prevent unintentional sliding.

* * * * *